US008446293B2

(12) United States Patent
Stadjuhar, Jr. et al.

(10) Patent No.: US 8,446,293 B2
(45) Date of Patent: May 21, 2013

(54) TRAFFIC SIGN SYSTEM THAT USES THE NATIONAL TRANSPORTATION COMMUNICATIONS FOR INTELLIGENT SYSTEMS PROTOCOL

(75) Inventors: Robert C. Stadjuhar, Jr., Colorado Springs, CO (US); Eugene Daigle, Woodland Park, CO (US)

(73) Assignee: Skyline Corporation, Colorado Springs, CO (US)

( * ) Notice: Subject to any disclaimer, the term of this patent is extended or adjusted under 35 U.S.C. 154(b) by 800 days.

(21) Appl. No.: 12/575,646

(22) Filed: Oct. 8, 2009

(65) Prior Publication Data

US 2010/0127893 A1 May 27, 2010

Related U.S. Application Data

(63) Continuation-in-part of application No. 11/593,277, filed on Nov. 6, 2006.

(51) Int. Cl.
*G08B 21/00* (2006.01)

(52) U.S. Cl.
USPC ..... 340/907; 340/905; 40/447; 345/33

(58) Field of Classification Search
USPC ..... 340/905, 907, 691.6; 345/33, 34, 345/2.1–2.3; 40/447
See application file for complete search history.

(56) References Cited

U.S. PATENT DOCUMENTS 6,088,008 A * 7/2000 Reeder ..... 345/33
2005/0231385 A1* 10/2005 Haase ..... 340/905

* cited by examiner

*Primary Examiner* — Jeffrey Hofsass
(74) *Attorney, Agent, or Firm* — Dale B Halling

(57) ABSTRACT

The invention is directed to a traffic sign system that has a number of information centers. A communication network provides a communication path between the information centers. The communication network is National Transportation Communications for Intelligent Transportation Systems Protocol (NTCIP) compliant. A sign controller is in communication with the information centers through the communication network. A first sign has a first address with a local control link to the sign controller. The local control link is not National Transportation Communications for Intelligent Transportation Systems Protocol compliant. A second sign has a second address with a second local control link to the sign controller. The second local control link is not National Transportation Communications for Intelligent Transportation Systems Protocol compliant.

20 Claims, 7 Drawing Sheets

TRAFFIC SIGN SYSTEM THAT USES THE NATIONAL TRANSPORTATION COMMUNICATIONS FOR INTELLIGENT SYSTEMS PROTOCOL

RELATED APPLICATIONS

The present invention claims priority on and is a continuation-in-part of, Ser. No. 11/593,277, filed on Nov. 6, 2006, entitled "Variable Message Sign Control System" and is hereby incorporated by reference.

STATEMENT REGARDING FEDERALLY SPONSORED RESEARCH

Not Applicable

THE NAMES OF THE PARTIES TO A JOINT RESEARCH AGREEMENT

Not Applicable

REFERENCE TO A SEQUENCE LISTING, A TABLE, OR A COMPUTER PROGRAM LISTING

Not Applicable

BACKGROUND OF THE INVENTION

Variable message signs are used on roadways to inform motorists of hazards and traffic conditions. Each variable message sign has a controller that has a direct communication link to a Remote Management Station (RMS). Often the direct communication link is a fiber optic link, which is expensive to install and requires an expensive fiber modem. In addition, the direct communication link requires an overhead intensive communication protocol such as NTCIP (National Transportation Communication for ITS [Intelligent Transportation Systems] Protocol). In addition, each of these direct communication links and its associated hardware are potential failure points as is each of the controllers. In addition, many variable message signs contain information from a wide variety of sources. For instance, a sign may contain toll information, travel time and exit information. The sources for each of these messages may originate at different locations. Presently, it is necessary to combine this information at a remote management station and when an update to any of the messages is received the sign must be rewritten in its entirety. This process is cumbersome for the Remote Management Station, requires system coordination, and is prone to error.

Thus, there exists a need for a sign controller system that is less expensive to install and operate and increases the reliability for variable message signs and changeable sign

BRIEF SUMMARY OF INVENTION

A traffic sign system that overcomes these and other problems has a number of information centers. A communication network provides a communication path between the information centers. The communication network is National Transportation Communications for Intelligent Transportation Systems Protocol (NTCIP) compliant. A sign controller is in communication with the information centers through the communication network. A first sign has a first address with a local control link to the sign controller. The local communication link is not National Transportation Communications for Intelligent Transportation Systems Protocol compliant. A second sign has a second address with a second local control link to the sign controller. The second local control link is not National Transportation Communications for Intelligent Transportation Systems Protocol compliant.

Using this system a single sign controller can control multiple physical and virtual signs. As a result only a single physical communication link is necessary between the sign controller and the remote management station. The system allows a logical communication path from different information centers directly to the sign. The signs may be virtual signs, which are defined areas within a group of pixels, or multiple physical signs. This reduces the need for grouping information from a variety of information centers to a central control station. This reduces the cost of installation, the cost of upgrading signs across multiple information centers and increases the flexibility of signs.

DETAILED DESCRIPTION OF THE INVENTION

The invention is directed to a traffic sign system that has a number of information centers. The signs are part of an ITS (Intelligent Transportation System) and are mostly used for congestion control incident management, amber alerts, and safety. A communication network provides a communication path between the information centers. The communication network is National Transportation Communications for Intelligent Transportation Systems Protocol (NTCIP) compliant. A sign controller is in communication with the information centers through the communication network. A first sign has a first address with a local control link to the sign controller. The local control link is not National Transportation Communications for Intelligent Transportation Systems Protocol compliant. A second sign has a second address with a second local control link to the sign controller. The second local control link is not National Transportation Communications for Intelligent Transportation Systems Protocol compliant.

Using this system a single controller can control multiple physical and virtual signs. As a result, only a single physical communication link is necessary between the sign controller and the remote management system. The system allows a logical communication path from different information centers directly to the sign. The signs may be virtual signs, which are defined areas within a group of pixels, or physical signs. This reduces the need for grouping information from a variety of information centers to a central control station. This reduces the cost of installation and maintenance, and the cost of adding signs across multiple information centers and increases the flexibility of signs.

Figure 1:
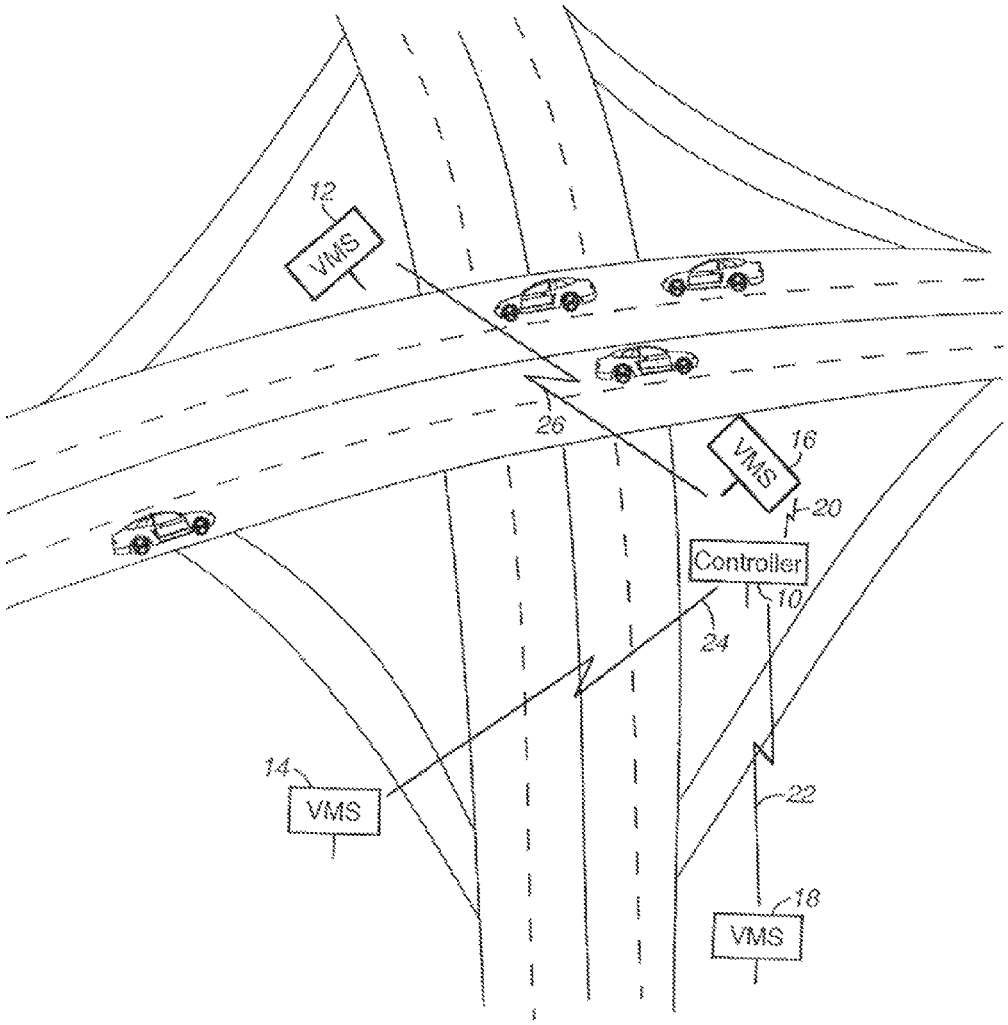
FIG. 1 is a diagram of a variable message sign control system in a typical freeway setting in accordance with one embodiment of the invention.

FIG. 1 is a diagram of a variable message sign control system in a typical freeway setting in accordance with one embodiment of the invention. The variable message sign control system has a sign controller 10. The sign controller 10 is commonly placed either in one of the plurality of variable message signs (VMS) 12, 14, 16, 18 or in a pole or ground mounted enclosure. The sign controller 10 has a number of local control links 20, 22, 24, 26 that allow the sign controller 10 to communicate with each of the variable message signs (VMS) 12, 14, 16, 18. The local control links 20, 22, 24, 26 may be wireless links, such as wireless Ethernet, or may be wired communication links or a combination of both. The variable message signs (VMS) 12, 14, 16, 18 sign face displays information about hazard or traffic conditions commonly for interstates or freeways. For instance, a variable message sign may display a message that there is an accident ahead or that the commute time though downtown is thirty minutes. These variable message signs are not standard three color traffic lights and come in a wide variety of form factors. While the link between the sign controller and remote management station is NTCIP compliant, the local links 20, 22, 24, 26 are not NTCIP compliant and use an efficient data format to reduce the overhead and cost of these local links.

Figure 2:
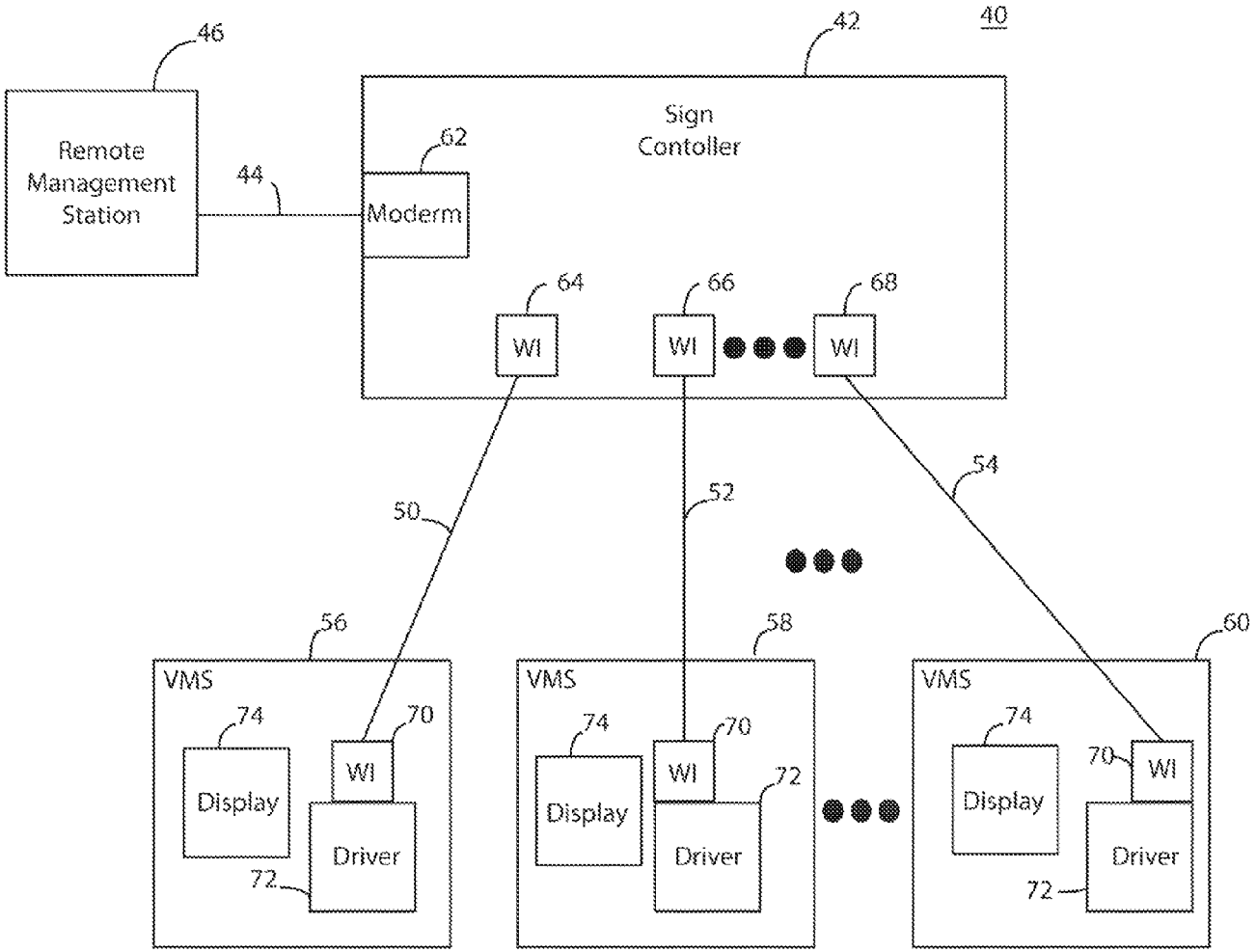
FIG. 2 is a block diagram of a variable message sign control system in accordance with one embodiment of the invention.

FIG. 2 is a block diagram of a variable message sign control system 40 in accordance with one embodiment of the invention. The system 40 has sign controller 42. The sign controller 42 has a communication link, remote management station communication link 44, with the Remote Management Station (RMS) 46. Note the remote management station may also be called the traffic operations center or traffic management center. In addition, the sign controller 42 has a plurality of local control links 50, 52, 54 that connect the sign controller 42 to a plurality of variable message signs (VMS) 56, 58, 60. The sign controller 42 has a modem 62 for communication over the RMS communication link 44. In one embodiment, the RMS communication link 44 is a fiber optic link and the modem 62 is a fiber optic modem and the communication protocol for the RMS communication link 44 is NTCIP (National Transportation Communication for ITS [Intelligent Transportation Systems] Protocol). The sign controller 42 also has a plurality of local interfaces (WI) 64, 66, 68 for communicating over the local control links 50, 52, 54. In one embodiment, these local control links 50, 52, 54 are wireless control links, however wired control links are also contemplated or a combination of both. Ideally, the communication protocol for links 59, 52, 54 used is any of a number of overhead efficient communication protocols.

The variable message signs 56, 58, 60 all have a communication interface (WI) 70. A driver 72 of the variable message signs 56, 58, 60 controls the sign face 74. The driver may include control and feedback of display and environment systems. A sign face includes both variable message signs and changeable message signs.

In operation the RMS 46 determines the message each variable message sign 56, 58, 60 should display. This information is transmitted over the RMS communication link 44 to the sign controller 42. The sign controller 42 schedules each message for display on the appropriate variable message sign 56, 58, 60. The message to be displayed is transmitted from the sign controller 42 to the appropriate variable message sign 56, 58, 60 over a local control link 50, 52, 54. The driver 72 then drives the sign face 74. The driver 72 determines a brightness of each sign face element based on a number factors including the ambient light. The driver 72 reads the sign face output, by determining an amount of power each sign face element is consuming. A picture or representation of the displayed message is transmitted to the sign controller 42. This information is forwarded to the RMS 46. The drivers monitor a number of environmental conditions including: internal temperature of the sign; external temperature; humidity; ventilation air flow amounts; power supply status, etc. These measurements are used to construct an environmental status message that is transmitted to the sign controller 42. The sign controller 42 forwards the environmental message to the RMS. In addition, the environmental driver may turn on or off a fan, or advance a filter material based on these measurements.

This system 40 eliminates the need for multiple sign controllers, multiple expensive communication links to the RMS and reduces the number of potential failure points. It also eliminates multiple ground or pole mounted cabinets if the sign controller is not located in the sign. Thus there has been described a variable message sign control system that is less expensive to install and operate and increases the reliability for variable message signs.

Figure 3:
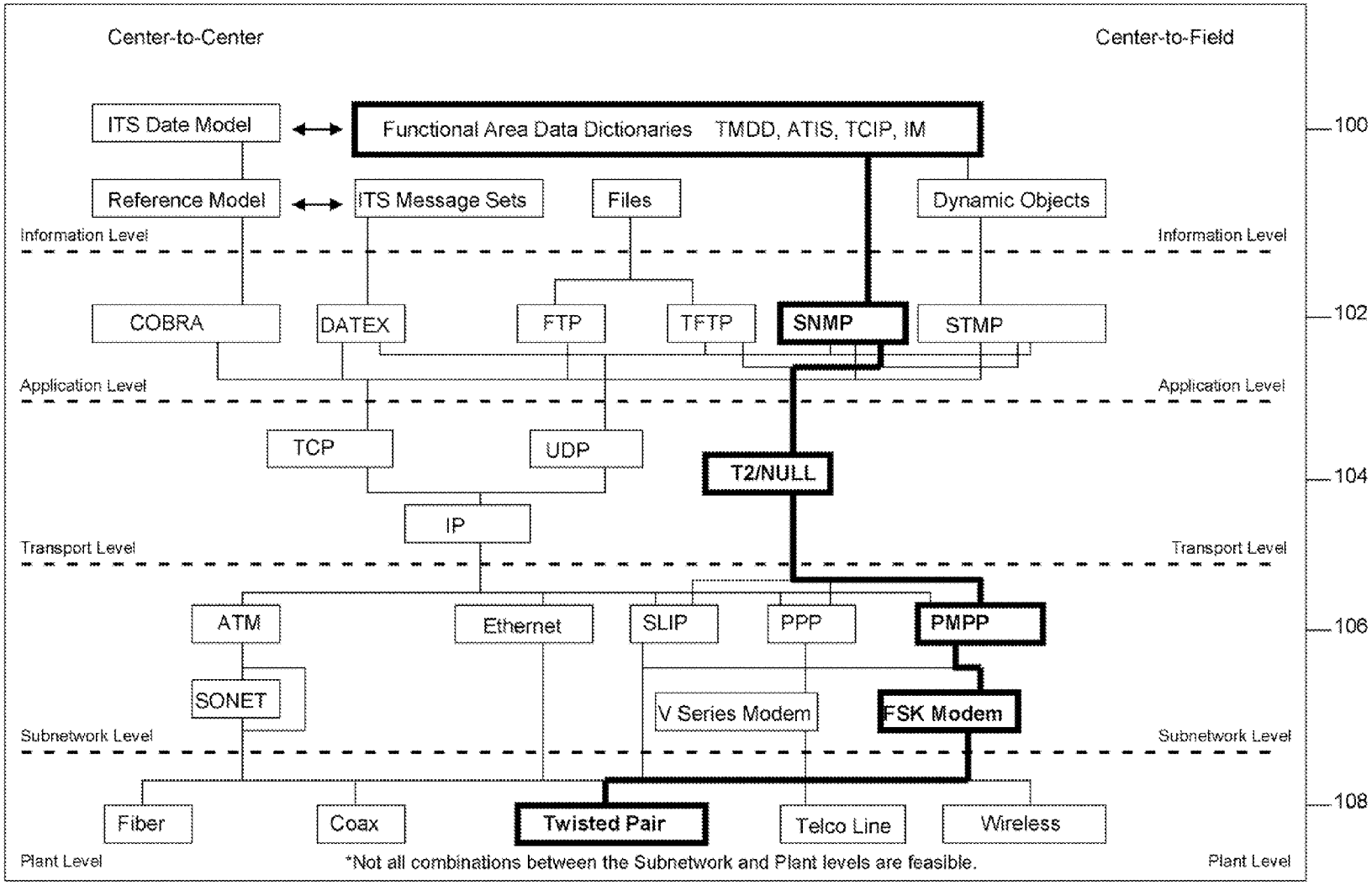
FIG. 3 is a chart of the communication and control layers for the National Transportation Communications for Intelligent Transportation Systems Protocol.

FIG. 3 is a chart of the communication and control layers for the National Transportation Communications for Intelligent Transportation Systems Protocol. In order to better understand the invention it is helpful to review the National Transportation Communications for Intelligent Transportation Systems Protocol (NTCIP) communication layers. NTCIP uses a layered or modular approach to communications standards, similar to the layering approach adopted by the Internet and the International Organization of Standards (ISO). In general, data communications between two computers or other electronic devices can be considered to involve the following primary layers, called "levels" in NTCIP, to distinguish them from those defined by ISO and the Internet. The information level 100 contains standards for the data elements, objects, and messages to be transmitted, for example, TCIP (Transit Communications Interface Profiles), NTCIP 1200 series Standards Publications, MS/ETMCC (Message Sets for External TMC Communication). NTCIP 1202 defines the data elements and conformance requirements for actuated traffic signal controllers.

The application level 102 contains standards for the data packet structure and session management., for example, SNMP (Simple Network Management Protocol), STMP (Simple Transport Management Protocol), DATEXASN (DATa Exchange), CORBA (Common Object Request Broker Architecture), FTP (File Transfer Protocol.

The transport level 104 contains standards for data packet subdivision, packet reassembly and routing when needed, for example, TCP (Transmission Control Protocol), UDP (User Datagram Protocol), IP (Internet Protocol).

The subnetwork level 106 contains standards for the physical interface, for example, modem, network interface card, CSU/DSU (Channel Service Unit/Data Service Unit), and the data packet transmission method, for example, HDLC (High-Level Data Link Control), PPP (Point-to-Point Protocol), Ethernet, ATM (Asynchronous Transfer Mode).

The plant level 108 consists of the physical transmission media used for communications, for example, copper wire, coaxial cable, fiber optic cable, wireless. It should be noted that the plant level is an infrastructure choice and not a standards selection choice. However, the plant level selection will have an impact on the subnetwork level selection to which it must interface.

Figure 4:
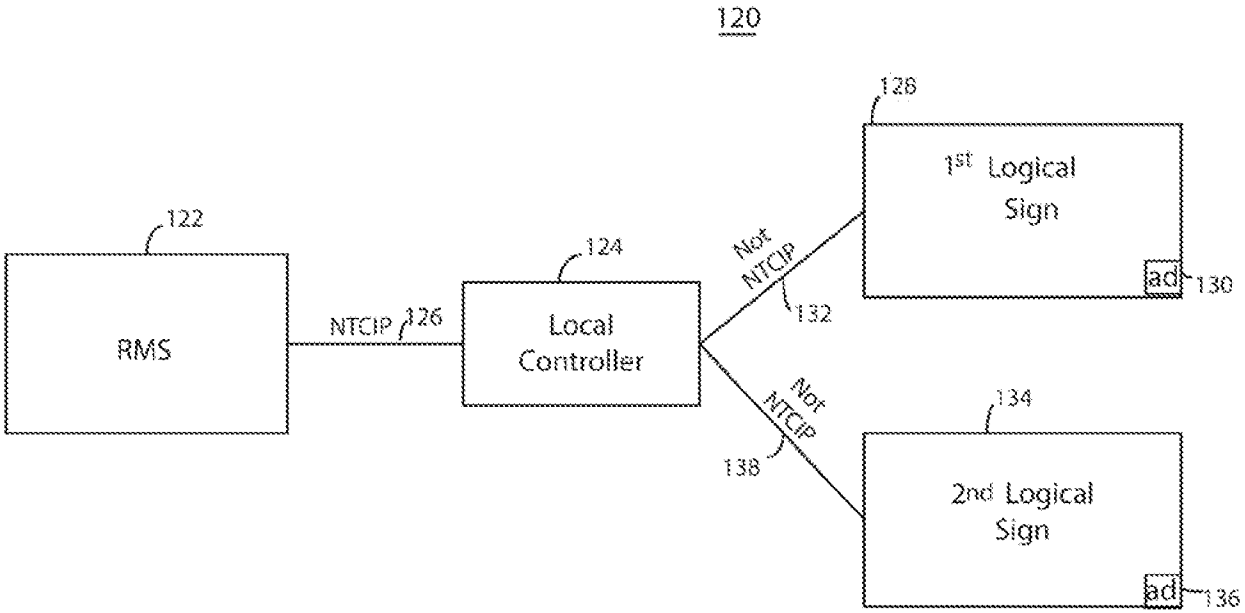
FIG. 4 is a block diagram of a traffic sign system in accordance with one embodiment of the invention.

FIG. 4 is a block diagram of a traffic sign system 120 in accordance with one embodiment of the invention. The system 120 has a Remote Management Station (RMS) 122. A local controller 124 has a communication link 126 to the RMS 122. The communication link 126 is National Transportation Communications for Intelligent Transportation Systems Protocol (NTCIP) compliant. A first logical sign 128 has a first logical address 130 and has a local control link 132 to the local controller 124. The local link 132 is not NTCIP compliant, but some overhead-efficient protocol. A second logical sign 134 has a second logical address 136. A second local control link 138 couples the second logical sign 134 to the local controller 124. The second local link is not NTCIP compliant. Local links are not NTCIP compliant in order to save on the overhead necessary to operate the link. A logical sign may be a physical sign or a might be a portion of a physical sign or it might be two physical signs that act in concert to form a message. Having a logical sign separate from the physical sign allows for significant flexibility of sign assets. For instance, logical signs allow for better utilization of variable message signs. Alternatively, having two physical signs form a logical sign allows easy updating of messages based on the location and type of the sign. For instance, the first physical sign can warn of an accident ahead and the second physical sign can warn that the left lane is closed. If these two physical signs are a single logical sign, it reduces the coordination required by the operators at the RMS. The system also reduces the cost of installation since a single sign controller operates many signs, instead of a separate sign controller for each sign with the associated backbone link 126.

Figure 5:
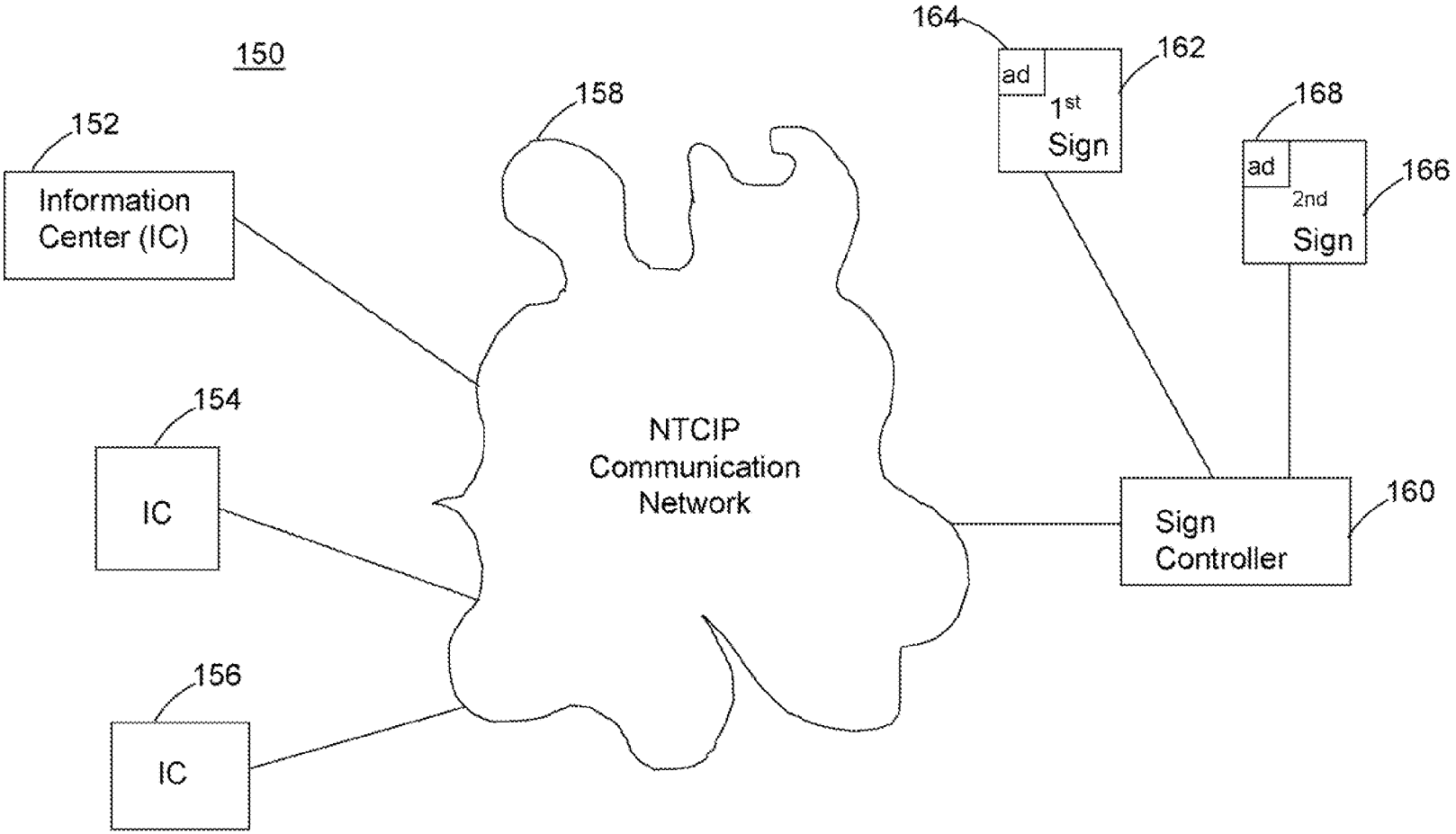
FIG. 5 is a block diagram of a traffic sign system in accordance with one embodiment of the invention.

FIG. 5 is a block diagram of a traffic sign system 150 in accordance with one embodiment of the invention. The system 150 has a number of information centers (IC) 152, 154, 156. A communication network 158 provides a communication path between the information centers 152, 154, 156. All or part of the communication network 158 is NTCIP compliant. A sign controller 160 is in communication with one or more of the information centers through the communication network 158. A first sign 162 has a first address 164 and communicates with the sign controller 160 through a local control link. A second sign 166 has a second address 168 and communicates over a local control link.

The first sign 162 and second sign 166 may be a virtual signs that share a common housing. The first virtual sign may be controlled by a first information center and the second virtual sign may be controlled by a second information center. The first information center may be toll rate setting center. The second information center may be a traffic management center. A third virtual sign may comprise the environmental and maintenance functions of a physical housing containing the first and second virtual sign. In another embodiment, a third virtual sign shares pixels with the first virtual sign and the second virtual sign and the message of the third virtual sign is time interleaved (multiple page/phased messages) with the first and second virtual sign messages. Note that an information center may include hazardous material information, speed control, high occupancy vehicle lanes, express land control and other information centers.

Figure 6:
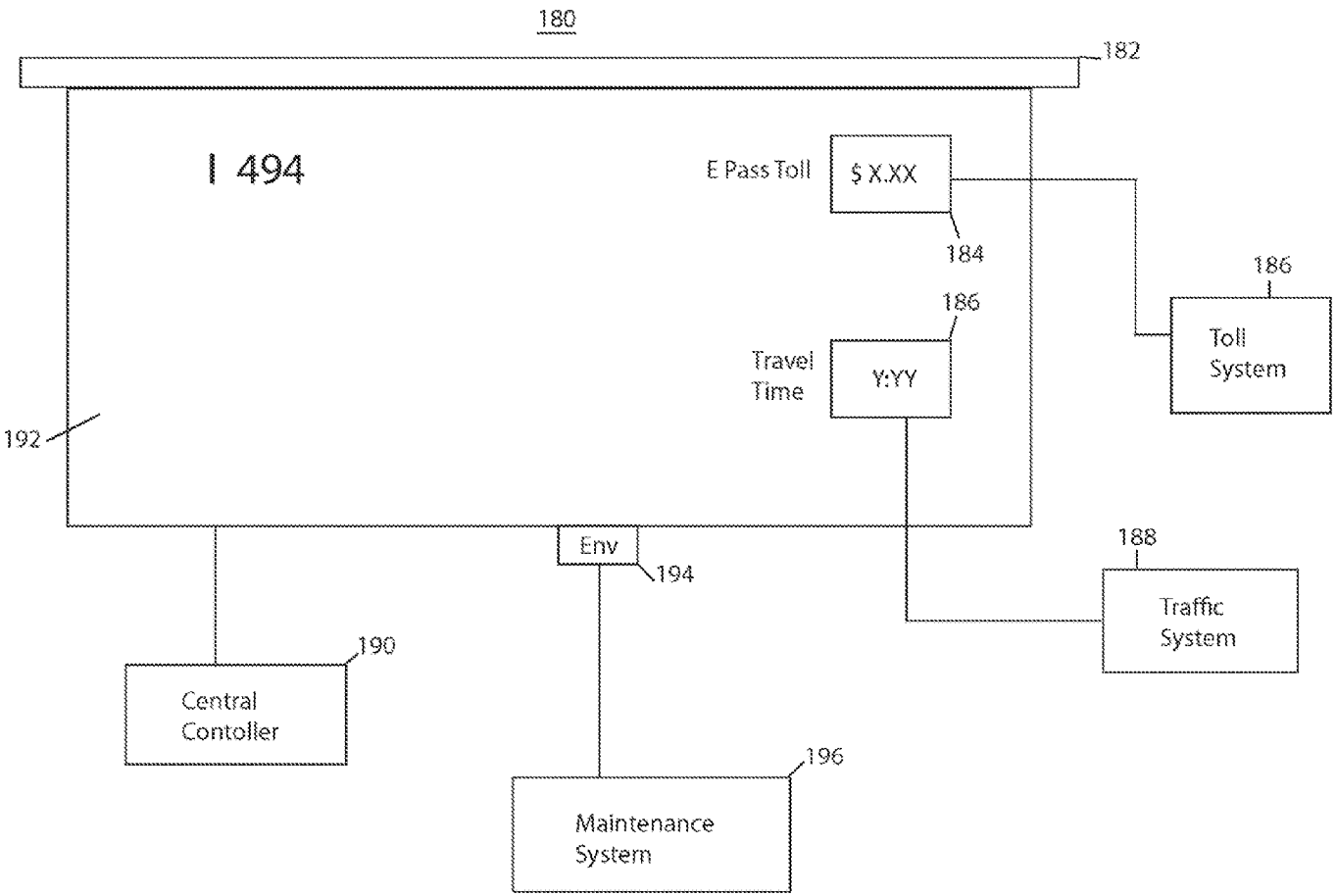
FIG. 6 is a logical drawing of traffic sign and system in accordance with one embodiment of the invention.

FIG. 6 is a logical drawing of a traffic sign and system 180 in accordance with one embodiment of the invention. The figure shows a sign 182 that may be a large variable message sign usually found near interstate highways. The sign 182 has a first virtual sign 184 that displays the toll rate to motorists. The first virtual sign 184 is in communication with a variable toll rate system 186. A second virtual sign 186 displays prevailing travel times and is in communication with a traffic system 188. A central controller 190 controls the a third virtual sign 192 that includes pixels not used by the first virtual sign 184 and the second virtual sign 186. In this case the third virtual sign just displays the interstate number. A fourth virtual sign 194 contains the environmental and maintenance aspects of the physical sign 182 and is in communication with the maintenance system 196. In another embodiment, sign 182 is a static sign with two small variable message signs 184, 186 embedded in or mounted to the static sign.

Figure 7:
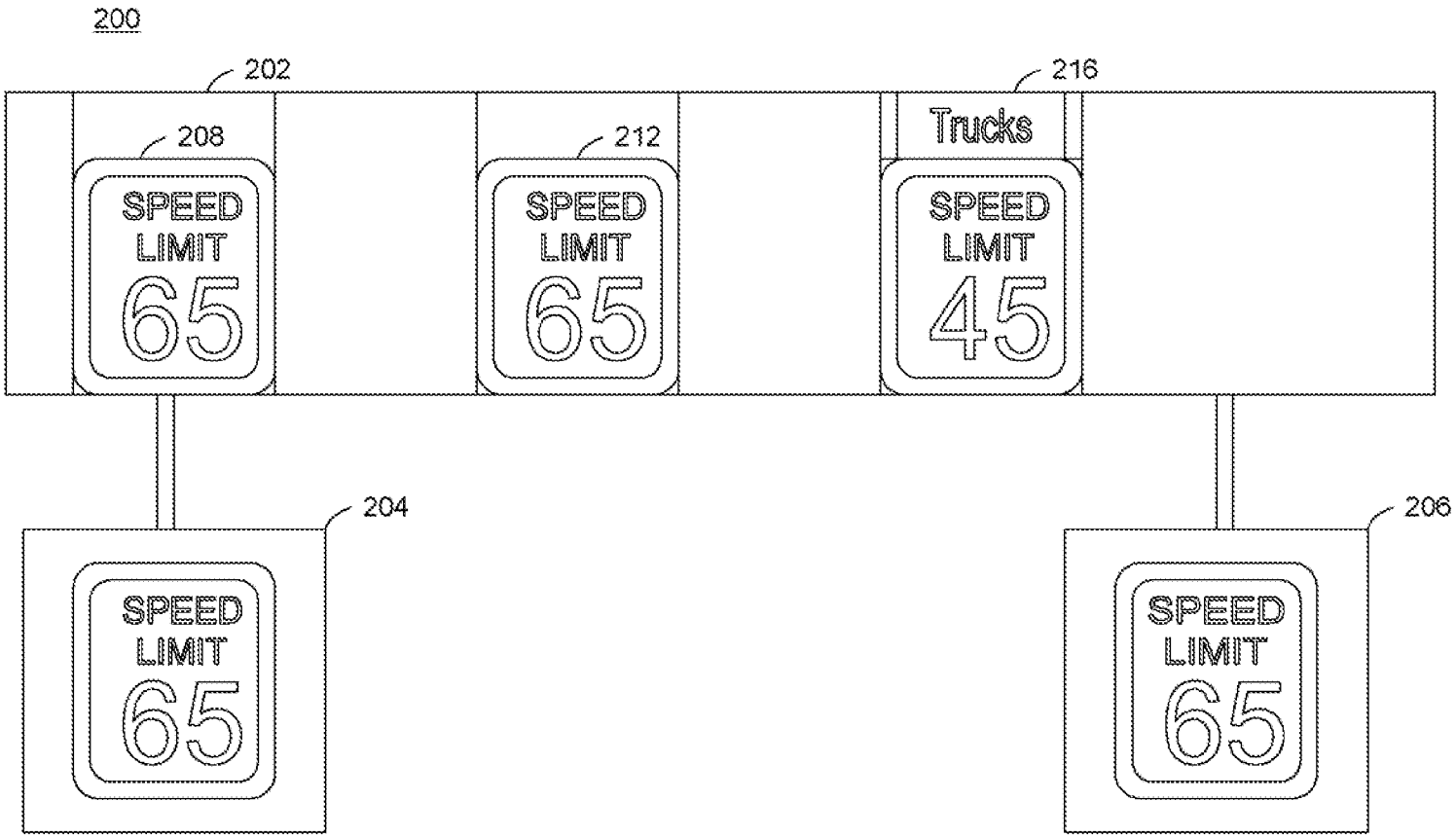
FIG. 7 is a traffic sign in accordance with one embodiment of the invention.

FIG. 7 is a traffic sign 200 in accordance with one embodiment of the invention. The sign 200 has three physical housings 202, 204, 206. The first housing 202 is a large variable message sign. The second 204 and third 206 housings are changeable message signs (e.g., mechanical scroll signs), that may be mounted on the poles holding the variable message sign 202. The variable message sign 202 is made of a three virtual or logical signs 208, 212, 216. The virtual signs show the speed limits and whether trucks are allowed in various lanes of the road. The mechanical scroll signs 204, 206 shows the speed limit. The advantage of a system with mechanical scroll signs is that if power is lost to the variable message sign 202 the motorist can no longer see the sign face. The scroll signs continue to display the speed limit even if power is lost to the signs.

The virtual sign 208 is controlled by a speed control information center. When the speed control information center changes the speed limit this information is passed to travel time information center. The travel time information center then updates travel time signs to reflect the change in the speed limits.

Thus there has been described a traffic sign system that reduces the cost of installation, uses the physical sign assets efficiently, allows direct control of virtual signs by separate information systems and displays consistent information across different types of signs. Using this system a single sign controller can control multiple physical and virtual signs. As a result, only a single physical communication link is necessary between the sign controller and the RMS. The system allows a logical communication path from different information centers directly to the sign. The signs may be virtual signs, which are defined areas within a group of pixels, or physical signs. This reduces the need for grouping information from a variety of information centers to a central control station. This reduces the cost of installation, the cost of upgrading signs across multiple information centers and increases the flexibility of signs.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A traffic sign system, comprising:

a remote management station;

a local controller having a communication link to the remote management station that is National Transportation Communications for Intelligent Transportation Systems Protocol compliant;

a first logical sign having a first logical address having a local control link with the local controller, wherein the local control link is not National Transportation Communications for Intelligent Transportation Systems Protocol compliant; and a second logical sign having a second logical address having a second local control link with the local controller, wherein the second local control link is not National Transportation Communications for Intelligent Transportation Systems Protocol compliant.

2. The traffic sign system of claim 1, wherein a first housing for the first logical sign and a second housing for the second logical sign are physically in separate nonadjacent locations.

3. The traffic sign system of claim 1, wherein a single housing physically contains the first logical sign and the second logical sign.

4. The traffic sign system of claim 1, further including a third party information provider central control system having a logical communication link with the first logical sign, wherein the logical communication link is National Transportation Communications for Intelligent Transportation Systems Protocol compliant.

5. The traffic sign system of claim 4, wherein the third party information provider central control system is a toll rate setting system.

6. The traffic sign system of claim 4, wherein the third party information provider central control system is a travel time system.

7. The traffic sign system of claim 3, further including a third logical sign that includes a group of maintenance and environmental information for both the first logical sign and the second logical sign.

8. The traffic sign system of claim 1, further including a first physical sign and a second physical sign, the first physical sign and the second physical sign functioning together to form the first logical sign.

9. The traffic sign system of claim 8, further including a third logical sign that is part of the variable message sign and the third logical sign is time interleaved with the first logical sign and the second logical sign.

10. The traffic sign system of claim 1, wherein a set of first permissions is assigned to the first logical sign.

11. The traffic sign system of claim 10, wherein a number of pixels are assigned to the first logical sign.

12. A traffic sign system, comprising:

a plurality of information centers;

a communication network providing a communication path between the plurality of information centers, wherein the communication network is National Transportation Communications for Intelligent Transportation Systems Protocol compliant;

a sign controller in communication with the plurality of information centers through the communication network a first sign having a first address having a local control link with the sign controller, wherein the first local control link is not National Transportation Communications for Intelligent Transportation Systems Protocol compliant; and a second sign having a second address having a second local control link with the sign controller, wherein the second local control link is not National Transportation Communications for Intelligent Transportation Systems Protocol compliant.

13. The system of claim 12, wherein the first sign is a first virtual sign and the second sign is a second virtual sign and the first sign and the second sign share a common housing.

14. The system of claim 12, wherein the first sign is updated by a toll setting information center.

15. The system of claim 12, wherein the second sign is controlled by a traffic management center.

16. The system of claim 13, further including a third virtual sign that is in communication with a maintenance center.

17. The system of claim 16, wherein the third virtual sign logically contains the environmental and maintenance functions of the common housing.

18. The system of claim 13, further including a third virtual sign that shares a plurality of pixels with the first virtual sign and the second virtual sign and the third virtual sign is time interleaved with the first virtual sign.

19. The system of claim 12, further including a set of permissions associated with the first sign.

20. The system of claim 12, wherein the first sign and the second sign function together to form a first virtual sign.

* * * * *